US010102686B2

(12) United States Patent
Oberhelman et al.

(10) Patent No.: US 10,102,686 B2
(45) Date of Patent: Oct. 16, 2018

(54) LAP COUNTING SYSTEM

(71) Applicants: Dennis Kent Oberhelman, Napoleon, MO (US); Donna Gwen Oberhelman, Napoleon, MO (US)

(72) Inventors: Dennis Kent Oberhelman, Napoleon, MO (US); Donna Gwen Oberhelman, Napoleon, MO (US)

( * ) Notice: Subject to any disclaimer, the term of this patent is extended or adjusted under 35 U.S.C. 154(b) by 377 days.

(21) Appl. No.: 14/750,233

(22) Filed: Jun. 25, 2015

(65) Prior Publication Data

US 2016/0375342 A1 Dec. 29, 2016

(51) Int. Cl.

| | |
|---|---|
| ***G07C 1/22*** | (2006.01) |
| ***A63B 69/12*** | (2006.01) |
| ***A63B 71/06*** | (2006.01) |

(52) U.S. Cl.

CPC ..... *G07C 1/22* (2013.01); *A63B 69/12* (2013.01); *A63B 71/06* (2013.01); *A63B 71/0686* (2013.01); *A63B 2071/0694* (2013.01); *A63B 2208/03* (2013.01); *A63B 2220/17* (2013.01); *A63B 2220/801* (2013.01); *A63B 2220/83* (2013.01); *A63B 2225/60* (2013.01); *A63B 2244/20* (2013.01)

(58) Field of Classification Search

CPC .. G07C 1/22; G07C 1/24; A63B 69/12; A63B 71/06; A63B 71/0686

See application file for complete search history.

(56) References Cited

U.S. PATENT DOCUMENTS

| | | | | |
|---|---|---|---|---|
| 4,518,266 | A | 5/1985 | Dawley | |
| 4,700,369 | A | 10/1987 | Siegal et al. | |
| 4,780,085 | A | 10/1988 | Malone | |
| 5,136,621 | A | 8/1992 | Mitchell et al. | |
| 5,285,428 | A | 2/1994 | Rosow et al. | |
| 5,349,569 | A * | 9/1994 | Tanaka | A63B 71/0686 200/52 R |
| D462,629 | S | 9/2002 | Tran et al. | |
| 8,472,285 | B2 | 6/2013 | Day | |
| 9,778,622 | B2 * | 10/2017 | Firmin | G04F 10/00 |
| 2005/0243651 | A1 * | 11/2005 | Bailey | A63B 69/12 368/10 |
| 2010/0304934 | A1 * | 12/2010 | Woodson | A63B 24/0062 482/8 |

* cited by examiner

*Primary Examiner* — Lawrence Galka

(57) ABSTRACT

A lap counting system includes a pool that has an outer wall. The outer wall has an inside surface and the pool may contain a liquid. A tracking unit is coupled to the pool. The tracking unit is positioned on the inside surface such that the tracking unit may be submerged in the liquid. Thus, the tracking unit is accessible to a swimmer. The tracking unit is sensitive to touch such that the tracking unit may be engaged by the swimmer each time the swimmer completes a lap in the pool. Thus, the tracking unit records and times each lap swam by the swimmer.

7 Claims, 6 Drawing Sheets

LAP COUNTING SYSTEM

BACKGROUND OF THE DISCLOSURE

Field of the Disclosure

The disclosure relates to counting devices and more particularly pertains to a new counting device for recording and timing laps swam in a pool.

SUMMARY OF THE DISCLOSURE

An embodiment of the disclosure meets the needs presented above by generally comprising a pool that has an outer wall. The outer wall has an inside surface and the pool may contain a liquid. A tracking unit is coupled to the pool. The tracking unit is positioned on the inside surface such that the tracking unit may be submerged in the liquid. Thus, the tracking unit is accessible to a swimmer. The tracking unit is sensitive to touch such that the tracking unit may be engaged by the swimmer each time the swimmer completes a lap in the pool. Thus, the tracking unit records and times each lap swam by the swimmer.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
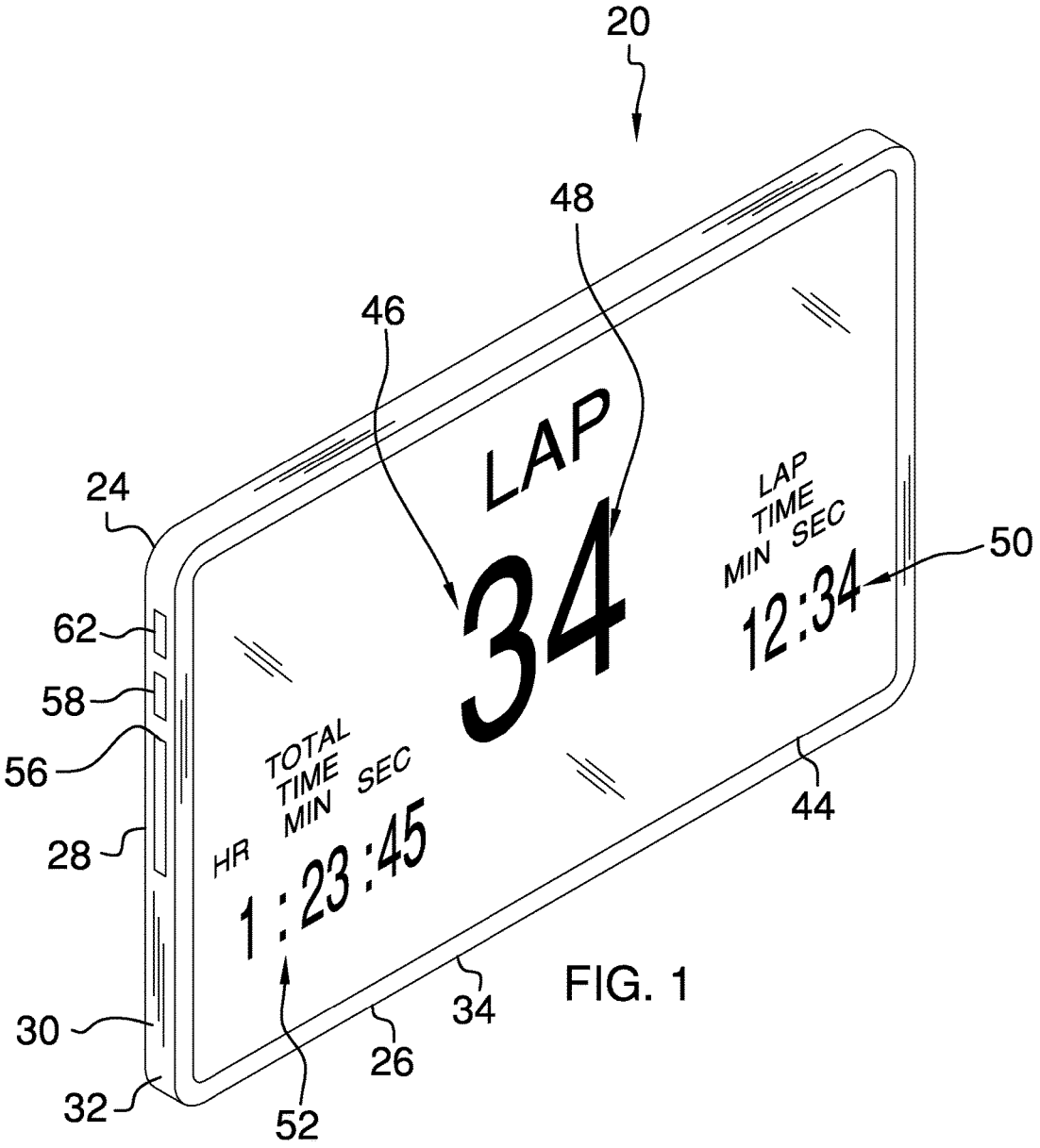
FIG. 1 is a perspective view of a lap counting system according to an embodiment of the disclosure.
Figure 2:
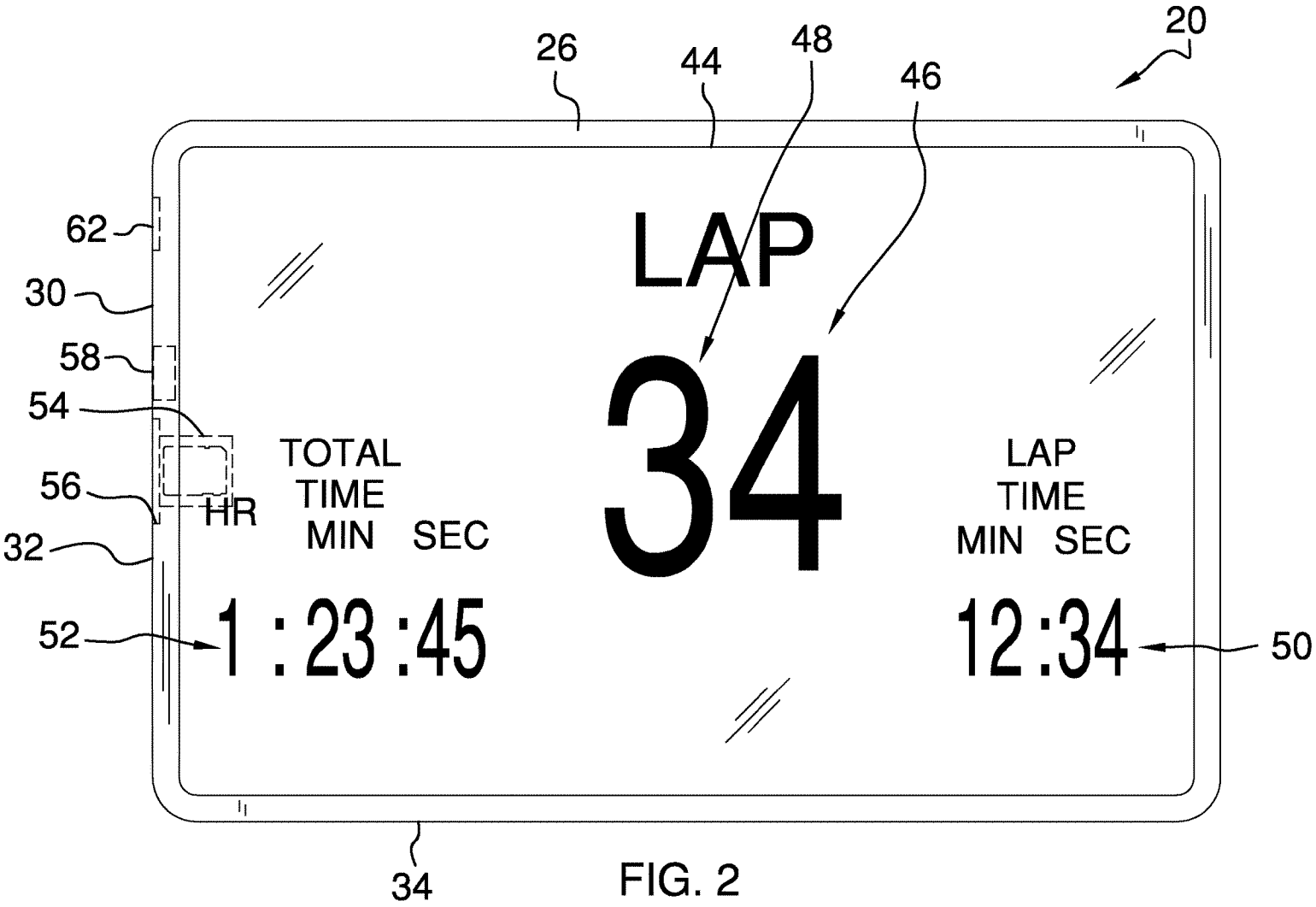
FIG. 2 is a front view of an embodiment of the disclosure.
Figure 3:
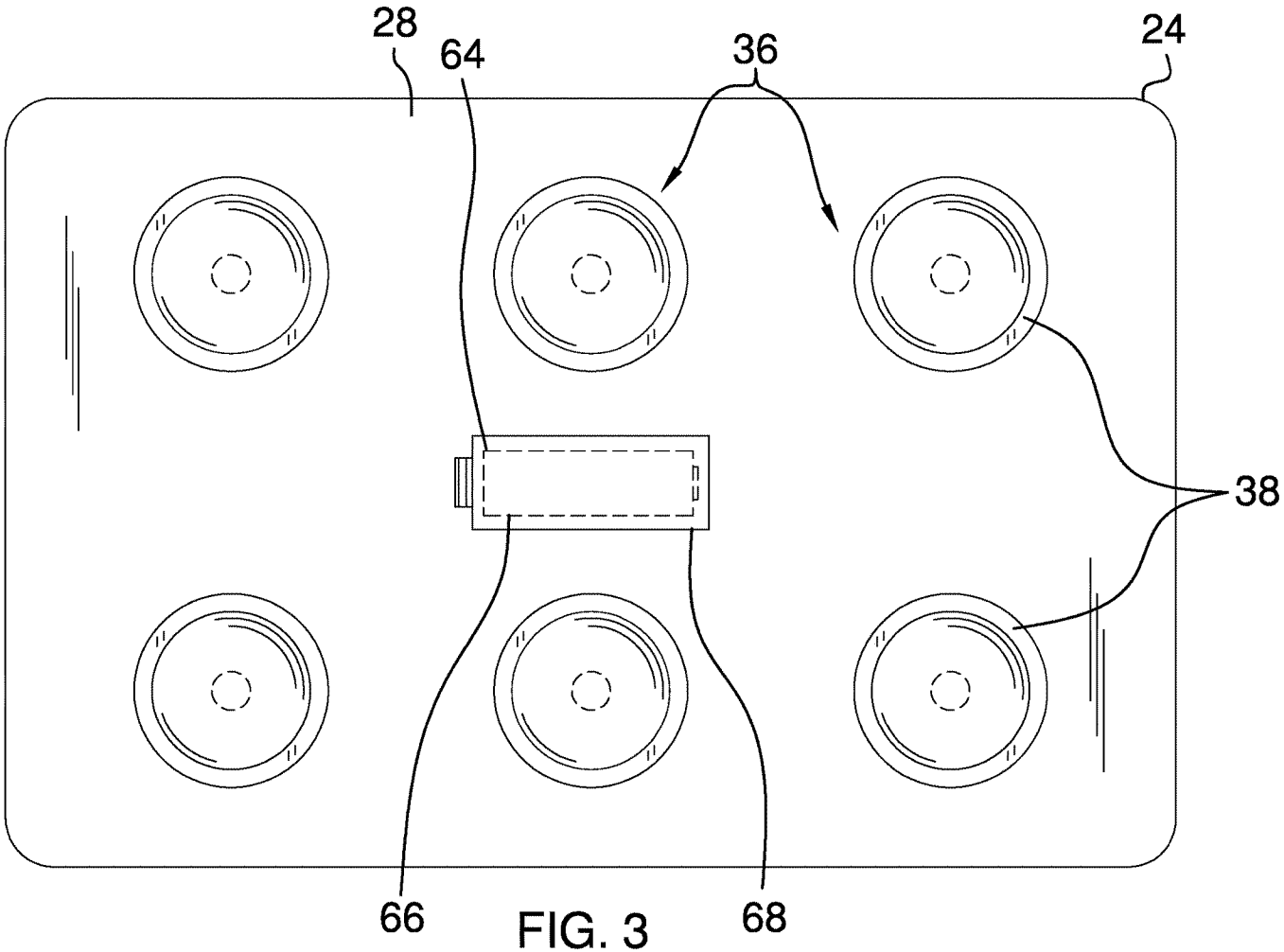
FIG. 3 is a back view of an embodiment of the disclosure.
Figure 4:
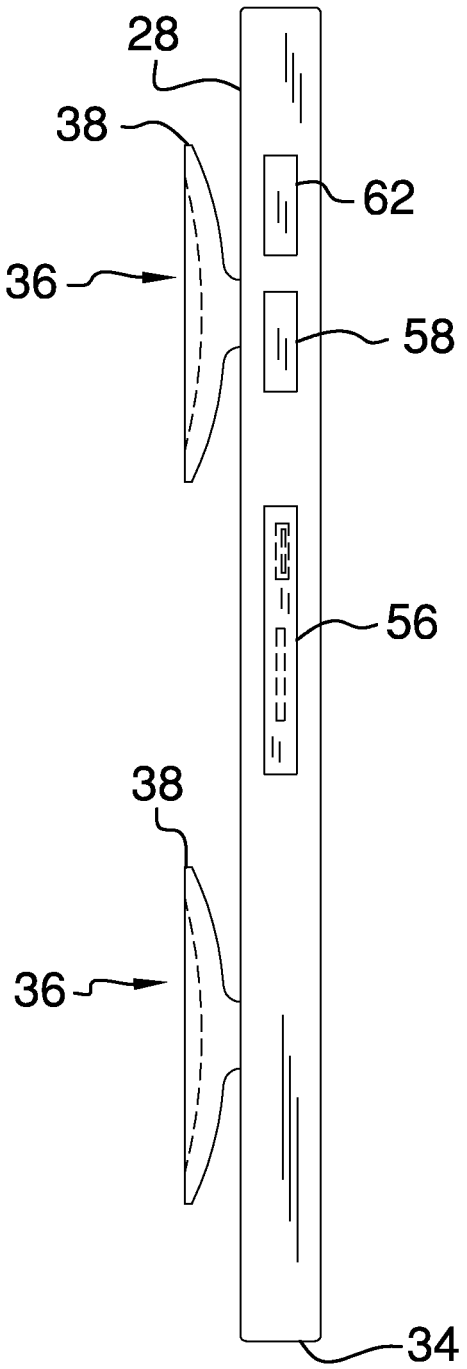
FIG. 4 is a right side view of an embodiment of the disclosure.
Figure 5:
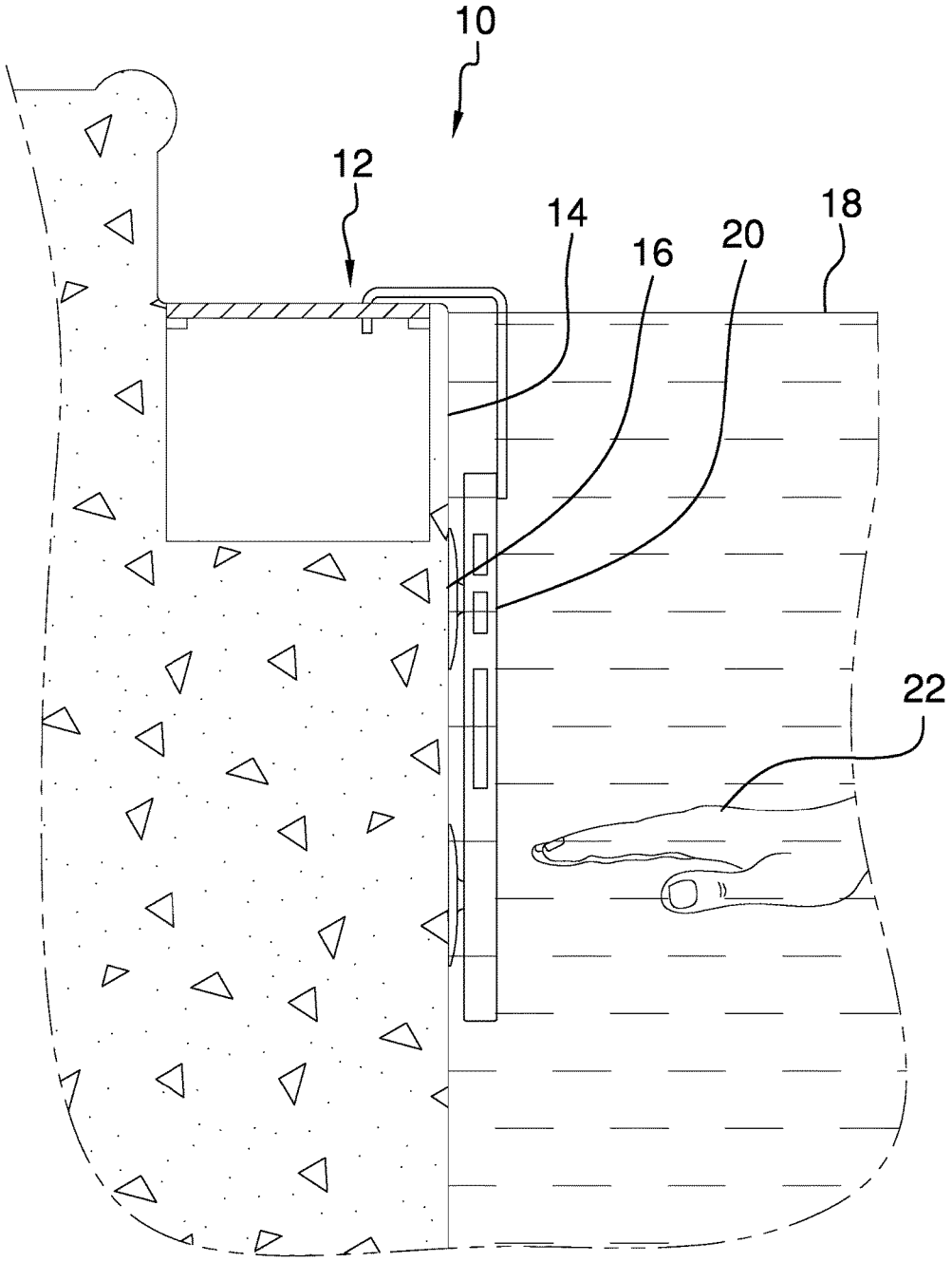
FIG. 5 is a perspective in-use view of an embodiment of the disclosure.
Figure 6:
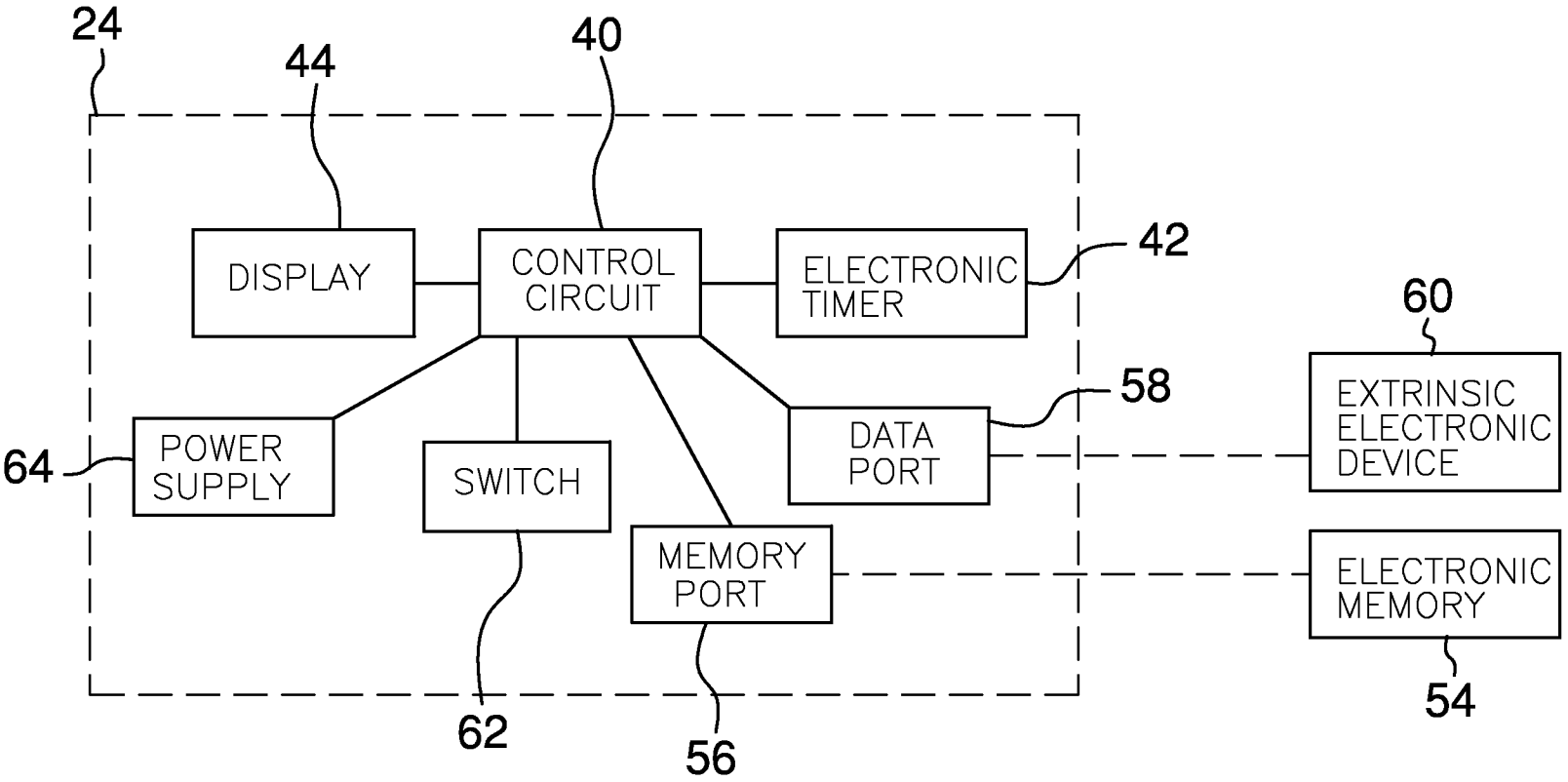
FIG. 6 is a schematic view of an embodiment of the disclosure.

With reference now to the drawings, and in particular to FIGS. 1 through 6 thereof, a new counting device embodying the principles and concepts of an embodiment of the disclosure and generally designated by the reference numeral 10 will be described.

As best illustrated in FIGS. 1 through 6, the lap counting system 10 generally comprises a pool 12 that has an outer wall 14. The outer wall 14 has an inside surface 16 and the pool 12 may contain a liquid 18. The liquid 18 may be water and the pool 12 may be a swimming pool or the like.

A tracking unit 20 is coupled to the pool 12. The tracking unit 20 is positioned on the inside surface 16 such that the tracking unit 20 is substantially submerged in the liquid 18. Thus, the tracking 20 unit is accessible to a swimmer 22. The tracking unit 20 is sensitive to touch such that the tracking unit 20 may be engaged by the swimmer 22 each time the swimmer 22 completes a lap in the pool 12. Thus, the tracking unit 20 records and times each lap swam by the swimmer 22.

The tracking unit 20 comprises a housing 24 that has a front wall 26, a back wall 28 and a peripheral edge 30 extending between the front wall 26 and the back wall 28. The housing 20 may have a width ranging between approximately thirty inches and thirty six inches and a height ranging between approximately twenty inches and twenty six inches. The peripheral edge 30 of the housing 24 has a first lateral side 32 and a bottom side 34.

An attachment 36 is coupled to the back wall 28 and the attachment 36 engages the inside surface 16 such that the housing 24 is removably retained on the outer wall 14. The attachment 36 may comprise a plurality of suction cups 38 and the suction cups 38 may be spaced apart from each other and distributed on the back wall 28. Each of the suction cups 38 may suctionally engage the inside surface 16 of the pool 12.

A control circuit 40 is positioned within the housing 24 and the control circuit 40 includes an electronic timer 42. The control circuit 40 may comprise an electronic processor or the like. A display 44 is coupled to the front wall 26 and the display 44 is electrically coupled to the control circuit 40. The display 44 displays indicia 46 and the display 44 comprises a touch screen display. Thus, the display 44 may be manipulated by the swimmer 22 each time the swimmer 22 swims past the housing 24 thereby facilitating the control circuit 40 to record a number of laps and a duration of each lap. Additionally, the display 44 comprises a liquid resistant display such that the display 44 may be submerged in the liquid 18 without being adversely affected by the liquid 18.

The indicia 46 may comprise a number of laps completed 48 and the number of laps completed 48 may be centrally positioned on the display 44. The number of laps completed 48 may have a height on the display 44 ranging between approximately eight inches and ten inches such that the number of laps completed 48 is visible to the swimmer 22. The indicia 46 may further comprise a lap duration time 50 and the lap duration time 50 may have a height on the display 44 ranging between approximately five inches and seven inches. The indicia 46 may further comprise a total duration of time 52 and the total duration of time 52 may have a height on the display 44 ranging between three inches and five inches. Each of the lap duration time 50 and the total duration of time 52 are positioned adjacent to the bottom edge 34 of the housing 24.

An electronic memory 54 is removably coupled to the housing 24 and the electronic memory 54 is electrically coupled to the control circuit 40. The electronic memory 54 stores the number of laps completed and the lap duration time. The electronic memory 54 may comprise a memory card or the like.

A memory port 56 is provided and the memory port 56 is positioned on the first lateral side 32 of the housing 24. The memory port 56 is electrically coupled to the control circuit 40 and the memory port 56 insertably receives the electronic memory 54 such that the electronic memory 54 is removably coupled to the housing 24. A data port 58 is provided and the data port 58 may be positioned on the first lateral side 32. The data port 58 is electrically coupled to the control circuit 40. The data port 58 may be electrically coupled to an extrinsic electronic device 60 such that the number of laps and the duration of laps may be downloaded into the extrinsic electronic device 60. The data port 58 may comprise a USB port or the like. Each of the memory port 56 and the data port 58 are hermetically sealed such that the liquid is prevented from entering the housing 24.

A switch 62 is coupled to the housing 24 such that the switch 62 may be manipulated. The switch 62 may be positioned on the first lateral side 32 of the housing 24. The switch 62 is electrically coupled to the control circuit 40 such that the switch 62 turns the control circuit 40 on and off. A power supply 64 is coupled to the housing 24 and the power supply 64 is electrically coupled to the control circuit 40. The power supply 64 comprises at least one battery 66. A battery cover 68 is removably coupled to the back wall 28 of the housing 24. The power supply 64 is positioned beneath the battery cover 68.

In use, the housing 24 is positioned on the outer wall 14 of the pool 12 such that the housing 24 is substantially submerged in the liquid 18. The display 44 is manipulated by the swimmer 22 each time the swimmer 22 completes a lap. The electronic timer 42 records the lap duration time and the lap duration time is displayed on the display 44. The electronic memory 54 stores the number of times the display 44 is manipulated and the elapsed time between each sequential manipulation of the display 44. The display 44 additionally displays the total time the swimmer 22 has been swimming.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lap counting system for use in a pool having an outer wall, said outer wall having an inside surface, said pool being configured to contain a liquid comprising: a tracking unit being coupled to said pool, said tracking unit comprising a housing having a front wall, a back wall and a peripheral edge extending between said front wall and said back wall, said tracking unit being positioned on said inside surface of said outer wall of said pool such that said housing is downwardly spaced from an open top of said pool, an attachment being coupled to said back wall, said attachment engaging said inside surface such that said housing is removably retained on said outer wall, wherein said housing is configured to be fully submerged under a top surface of the liquid thereby facilitating said tracking unit to be accessible to a swimmer, said tracking unit being sensitive to touch wherein said tracking unit is configured to be engaged by the swimmer each time the swimmer completes a lap in said pool thereby facilitating said tracking unit to record and time each lap swam by the swimmer.

2. The system according to claim 1, wherein said tracking unit comprises a control circuit being positioned within said housing, said control circuit including a timer.

3. The system according to claim 2, further comprising a display being coupled to said front wall wherein said display is configured to be positioned under a top surface of the liquid, said display being electrically coupled to said control circuit wherein said display is configured to display indicia, said display comprising a touch screen display wherein said display is configured to be manipulated by the swimmer each time the swimmer swims past said housing thereby facilitating said control circuit to record a number of laps and a duration of each lap.

4. The system according to claim 3, further comprising an electronic memory being removably coupled to said housing, said electronic memory being electrically coupled to said control circuit wherein said electronic memory is configured to store the number of laps and the duration of each lap.

5. The system according to claim 4, further comprising a switch being coupled to said housing wherein said switch is configured to be manipulated, said switch being electrically coupled to said control circuit such that said switch turns said control circuit on and off.

6. The system according to claim 5, further comprising a power supply being coupled to said housing, said power supply being electrically coupled to said control circuit, said power supply comprising at least one battery.

7. A lap counting system for use in a pool having an outer wall, said outer wall having an inside surface, said pool being configured to contain a liquid comprising: a tracking unit being coupled to said pool, said tracking unit being positioned on said inside surface, said tracking unit being sensitive to touch wherein said tracking unit is configured to be engaged by the swimmer each time the swimmer completes a lap in said pool thereby facilitating said tracking unit to record and time each lap swam by the swimmer, said tracking unit comprising: a housing having a front wall, a back wall and a peripheral edge extending between said front wall and said back wall, said housing being coupled to said inside surface of said outer wall downwardly spaced from an open top of said pool, an attachment being coupled to said back wall, said attachment engaging said inside surface such that said housing is removably retained on said outer wall, a control circuit being positioned within said housing, said control circuit including a timer, a display being coupled to said front wall wherein said display is configured to be positioned under a top surface of the liquid wherein said housing is configured to be fully submerged under a top surface of the liquid thereby facilitating said tracking unit to be accessible to a swimmer, said display being electrically coupled to said control circuit wherein said display is configured to display indicia, said display comprising a touch screen display wherein said display is configured to be manipulated by the swimmer each time the swimmer swims past said housing thereby facilitating said control circuit to record a number of laps and a duration of each lap, an electronic memory being removably coupled to said housing, said electronic memory being electrically coupled to said control circuit wherein said electronic memory is configured to store the number of laps and the duration of each lap, a switch being coupled to said housing wherein said switch is configured to be manipulated, said switch being electrically coupled to said control circuit such that said switch turns said control circuit on and off, and a power supply being coupled to said housing, said power supply being electrically coupled to said control circuit, said power supply comprising at least one battery.

* * * * *